US006397121B1

(12) United States Patent
Kawamura et al.

(10) Patent No.: US 6,397,121 B1
(45) Date of Patent: May 28, 2002

(54) PROCESS AND APPARATUS FOR DETECTING LOOP STITCH OF TUBULAR KNITTED FABRIC, AND APPARATUS FOR LINKING TUBULAR KNITTED FABRIC

(75) Inventors: Sadao Kawamura, Otsu; Akira Ishii, Kusatsu; Takahiro Wada, Otsu; Takuya Fukitsuke, Tokai; Yushi Takeuchi, Kusatsu, all of (JP)

(73) Assignee: Dan Co., Ltd., Osaka (JP)

( * ) Notice: Subject to any disclaimer, the term of this patent is extended or adjusted under 35 U.S.C. 154(b) by 0 days.

(21) Appl. No.: 09/229,869

(22) Filed: Jan. 13, 1999

(51) Int. Cl.[7] ..... D04B 35/10; D05B 7/00

(52) U.S. Cl. ..... 700/141; 112/27; 112/475.02; 66/148

(58) Field of Search ..... 700/141, 143, 700/144; 66/148, 8, 58, 104, 166; 112/27, 25, 475.02

(56) References Cited

U.S. PATENT DOCUMENTS 5,133,198 A * 7/1992 Bachmann ..... 66/166

5,730,075 A * 3/1998 Moriguchi ..... 112/27

* cited by examiner

*Primary Examiner*—Peter Nerbun
(74) *Attorney, Agent, or Firm*—Jordan and Hamburg LLP

(57) ABSTRACT

There are provided a process and an apparatus for detecting loop stitches of a tubular knitted fabric and an apparatus for linking the tubular knitted fabric, which can automatically detect each of loop stitches formed in the tubular knitted fabric. According to the process for detecting the loop stitches, the tubular knitted fabric is extended by inserting a penetration element through the interior of the fabric having the loop stitches, and a multi-gradation image including an image of the loop stitches of the tubular knitted fabric extended by the penetration element is picked up. The locations of the loop stitches are detected by processing the multi-gradation image. The apparatus for detecting the loop stitches includes the penetration element, an image pickup device for picking up the multi-gradation image, and a loop stitch detecting section for detecting the locations of the loop stitches by processing the multi-gradation image.

24 Claims, 16 Drawing Sheets

Fig.9

| | | |

Fig.11

| | | |

PROCESS AND APPARATUS FOR DETECTING LOOP STITCH OF TUBULAR KNITTED FABRIC, AND APPARATUS FOR LINKING TUBULAR KNITTED FABRIC

FIELD OF THE INVENTION

This invention relates to a process and an apparatus for detecting loop stitches of a tubular knitted fabric and an apparatus for linking the tubular knitted fabric, and more particularly to the process and apparatus, which accurately detect the location of each loop stitch formed, for instance, in the tubular knitted fabric, and the apparatus which can link the tubular knitted fabric, based on the thus detected stitches.

DESCRIPTION OF THE PRIOR ART

Conventionally, in a knitted fabric for use as a material in a knitted product, in order to correctly link stitches of the product so as to have required size and shape, loop stitches which each have a larger loop than those of other stitches are formed of knitting yarn with slightly looser or larger stitches. When the loop stitches are linked, the operator stretches and enlarges the knitted fabric by his hands, and peers into the knitted fabric to find loop stitches. Then, he sets the fabric by manually inserting a point needle of a linking apparatus into the loop stitches, followed by sewing the fabric by a sewing machine. This linking operation is the same as in linking a tubular knitted fabric. First, the operator puts his hands into an open portion of the tubular knitted fabric to stretch and enlarge the same, and peers into the knitted fabric on a backward side thereof with respect to the operator, to find the loop stitches. Then, he sets the fabric by inserting the point needle of the linking apparatus into the loop stitches, followed by performing the same operation to the fabric on a frontward side with respect to the operator. Further, he superposes the loop stitches to be linked on each other, and sets the loop stitches to the point needle, followed by sewing the fabric by the sewing machine, to thereby perform linking.

Although to find the entire loop stitches as a row is relatively easy, to correctly find each of loop stitches requires experience and skill of the operator, since the loop stitches are formed by knitting yarn only with slightly loose or large stitches compared with other stitches. Therefore, for a person not skilled in the operation, an operation to find the loop stitches by observation requires a very long time period, which results in extremely degraded working efficiency. Especially, in the linking of tubular knitted fabrics, once the knitted fabric on the backward side is set to the linking apparatus, it is difficult to stretch the knitted fabric on the frontward side, and hence the above-mentioned degraded working efficiency becomes worse. Therefore, when the linking is performed, an inconvenience such as omission of linking at several loop stitches is unfavorably generated, resulting in reduced yield of products.

SUMMARY OF THE INVENTION

Therefore, it is a first object of the invention to provide a process for detecting loop stitches of a tubular knitted fabric, which is capable of automatically detecting each of the loop stitches formed in the tubular knitted fabric.

It is a second object of the invention to provide an apparatus for detecting the loop stitches, according to the above process.

It is a third object of the invention to provide an apparatus for linking the tubular knitted fabric, according to the above process.

To attain the first object, the invention provides a process for detecting loop stitches of a tubular knitted fabric, comprising the steps of extending the tubular knitted fabric by penetrating a penetration element through an interior of the tubular knitted fabric having the loop stitches formed therein, picking up a multi-gradation image including an image of loop stitches of the tubular knitted fabric extended by the penetration element, and detecting locations of the loop stitches by processing the multi-gradation image.

According to the process of the invention, an image of the knitted fabric on a frontward surface and an image of the knitted fabric on a backward surface are independently picked up, while stitches inclusive of the loop stitches are enlarged. As a result, the images of the knitted fabric on the frontward surface and the backward surface are prevented from being confused with each other, whereby locations of the loop stitches can be accurately detected.

The process may include the step of extending the tubular knitted fabric in a penetration direction of the penetration element.

According to the process, the image of the stitches inclusive of the loop stitches can be picked up in a further enlarged state. As a result, the locations of the loop stitches can be more accurately detected.

Further, the step of picking up multi-gradation image may be carried out in one plane.

According to the process, the image of a portion in the vicinity of the loop stitches of the tubular knitted fabric is picked up on a two-dimensional basis. As a result, the image of a plurality of the loop stitches can be collectively and simultaneously picked up, which dispenses with separate image pickup of each of the loop stitches of the tubular knitted fabric, leading to shortening of a detecting time period and hence improvement in detection efficiency.

The step of picking up multi-gradation image may be carried out by using light transmitted from the interior of the tubular knitted fabric to the exterior of the same. A plurality of emitters, e.g. LED may be arranged on an end surface of the penetration element, defining the slit, to thereby irradiate the stitches arranged on the slit from the inside of the slit.

According to the process, light transmitted through the tubular knitted fabric is received by image pickup means. As a result, the multi-gradation image is picked up, in which boundaries between fiber areas and stitch areas of the tubular knitted fabric can be clearly discriminated, whereby the locations of the loop stitches can be more accurately detected.

Further, the penetration element may be composed of an element having a slit therein, and the step of picking up multi-gradation image may include the steps of irradiating the slit, and using light transmitted from one side of the exterior of the tubular knitted fabric to the other side of the same through the slit.

According to the process, light transmitted through the tubular knitted fabric arranged on the slit is also received by the image pickup means. As a result, the multi-gradation image is picked up, in which the boundaries between the fiber areas and the stitch areas of the tubular knitted fabric arranged on the slit can be clearly discriminated, whereby the locations of the loop stitches on the slit can be more accurately detected.

Still further, the step of detecting the locations of the loop stitches may comprise the steps of converting the multi-gradation image into a binary image, converting the binary image into a labeled image composed of labeled regions, counting the number of picture elements of each of the labeled regions in the labeled image, and then extracting only labeled regions each having a larger number of picture elements than a predetermined value, the predetermined value being set to a value larger than a reference value corresponding to a minimum value of the number of picture elements forming a labeled region of each of the loop stitches in the labeled image, to thereby generate an extracted labeled image, and determining a location of each of the loop stitches by calculating a location of the labeled region of each of the loop stitches in the extracted labeled image.

According to the process, the loop stitch is extracted based on an area of a loop stitch region, and then the location of the loop stitch is determined. As a result, the locations of the loop stitches with various sizes can be detected.

The step of converting the multi-gradation image into the binary image may include the step of dividing the multi-gradation image into a plurality of small regions, and determining a binarization threshold value for each of the small regions, based on image features of each of the small regions.

In the process, the image of each portion is binarized according to illumination of each portion of the tubular knitted fabric. As a result, the boundaries of the fiber areas and the stitch areas are detected irrespective of the influence of the illumination of each portion of the tubular knitted fabric, leading to further accurate detection of the loop stitches.

According to the second object, the invention provides an apparatus for detecting loop stitches of a tubular knitted fabric, comprising a penetration element for extending the tubular knitted fabric by penetrating the same through an interior of the tubular knitted fabric having the loop stitches formed therein, image pickup means for picking up a multi-gradation image including an image of loop stitches of the tubular knitted fabric extended by the penetration element, and loop stitch detecting means for detecting locations of the loop stitches by processing the multi-gradation image.

According to the apparatus of the invention, an image of the knitted fabric on a frontward surface and an image of the knitted fabric on a backward surface are independently picked up, while stitches inclusive of the loop stitches are enlarged. As a result, the images of the knitted fabric on the frontward surface and the backward surface are prevented from being confused with each other, whereby the locations of the loop stitches can be accurately detected.

The apparatus may include upper retaining means for retaining the tubular knitted fabric at a location upper than the loop stitches, to thereby move the tubular knitted fabric in a penetration direction of the penetration element, and lower retaining means for retaining the tubular knitted fabric at a location lower than the loop stitches, to thereby move the tubular knitted fabric in the penetration direction of the penetration element.

According to the apparatus, the image of the stitches inclusive of the loop stitches can be picked up in a further enlarged state. As a result, the locations of the loop stitches can be more accurately detected.

Further, the penetration element may have surfaces on which the loop stitches are arranged, at least the surfaces of the penetration element being made flat, and the image pickup means may be disposed such that image pickup directions thereof are set at right angles with respect to a lateral direction of the flat surfaces of the penetration element.

According to the apparatus, the image of a portion in the vicinity of the loop stitches of the tubular knitted fabric is picked up on a two-dimensional basis. As a result, the image of a plurality of the loop stitches can be collectively and simultaneously picked up. Especially, when the loop stitches are arrange in a state where each of the location thereof is not necessary to be adjusted, separate image pickup of each of the loop stitches can be dispensed with, leading to shortening of a detecting time period and hence improvement in detection efficiency.

The penetration element may include light emitting means.

According to the apparatus, light transmitted through the tubular knitted fabric is received by the image pickup means. As a result, the multi-gradation image is picked up, in which boundaries between fiber areas and stitch areas of the tubular knitted fabric can be clearly discriminated, whereby the locations of the loop stitches can be more accurately detected.

Further, the penetration element may have a slit formed therein, and irradiating means for irradiating the slit.

According to the apparatus, light transmitted through the tubular knitted fabric arranged on the slit is also received by the image pickup means. As a result, the multi-gradation image is picked up, in which the boundaries between the fiber areas and the stitch areas of the tubular knitted fabric arranged on the slit can be clearly discriminated, whereby the locations of the loop stitches on the slit can be more accurately detected. The apparatus may have a device such as one composed of a plurality of emitters, e.g. LED arranged on an end surface of the penetration element, defining the slit, to thereby irradiate the stitches arranged on the slit from the inside of the slit.

Still further, the loop stitch detecting means may comprise means for converting the multi-gradation image into a binary image, means for converting the binary image into a labeled image composed of labeled regions, region extracting means for counting the number of picture elements of each of the labeled regions in the labeled image, and then extracting only labeled regions each having a larger number of picture elements than a predetermined value, the predetermined value being set to a value larger than a reference value corresponding to a minimum value of the number of picture elements forming a labeled region of each of the loop stitches in the labeled image, to thereby generate an extracted labeled image, and means for determining a location of each of the loop stitches by calculating a location of the labeled region of each of the loop stitches in the extracted labeled image.

According to the apparatus, the loop stitch is extracted based on an area of a loop stitch region, and then the location of the loop stitch is determined. As a result, the loop stitches and stitches other than those can be discriminated, to thereby correctly determine the location of each loop stitch.

The means for converting the multi-gradation image into the binary image may include means for dividing the multi-gradation image into a plurality of small regions, and determining a binarization threshold value for each of the small regions, based on image features of each of the small regions.

In the apparatus, the image of each portion is binarized according to illumination of each portion of the tubular knitted fabric. As a result, the boundaries of the fiber areas and the loop stitch areas are detected irrespective of the influence of the illumination of each portion of the tubular knitted fabric, leading to further accurate detection of the loop stitches.

To attain the third object, the invention provides an apparatus for linking a tubular knitted fabric having loop stitches formed therein, comprising a penetration element for extending the tubular knitted fabric by penetrating the same through an interior of the tubular knitted fabric having the loop stitches formed therein, image pickup means for picking up a multi-gradation image including an image of loop stitches of the tubular knitted fabric extended by the penetration element, loop stitch detecting means for detecting locations of the loop stitches by processing the multi-gradation image, a point needle for being inserted into the loop stitches, means for guiding the point needle to the locations of the loop stitches detected by the loop stitch detecting means, means for inserting the point needle to each of the loop stitches, and a sewing machine mechanism for linking the loop stitches into which the pointing needle is inserted.

According to the apparatus of the invention, an image of the knitted fabric on a frontward surface and an image of the knitted fabric on a backward surface are independently picked up, while stitches inclusive of the loop stitches are enlarged. As a result, the images of the knitted fabric on the frontward surface and the backward surface can be prevented from being confused with each other, and therefore the point needle can be accurately inserted into the loop stitches, to thereby correctly link the fabric so as to have desired size and shape.

The apparatus may include upper retaining means for retaining the tubular knitted fabric at a location upper than the loop stitches, to thereby move the tubular knitted fabric in a penetration direction of the penetration element, and lower retaining means for retaining the tubular knitted fabric at a location lower than the loop stitches, to thereby move the tubular knitted fabric in the penetration direction of the penetration element.

According to the apparatus, the image of the stitches inclusive of the loop stitches is picked up in a more enlarged state. As a result, the locations of the loop stitches can be more accurately detected, and the fabric can be correctly linked with the desired size and shape without fail.

Further, the penetration element may have surfaces on which the loop stitches are arranged, at least the surfaces of the penetration element being made flat, and the image pickup means may be disposed such that image pickup directions thereof are set at right angles with respect to the flat surfaces of the penetration element.

According to the apparatus, the image of a portion in the vicinity of the loop stitches of the tubular knitted fabric is picked up on a two-dimensional basis. As a result, the image of a plurality of the loop stitches can be collectively and simultaneously picked up, which dispenses with separate image pickup of each of the loop stitches, leading to shortening of a linking time period and hence improvement in production efficiency.

The penetration element may include light emitting means.

According to the apparatus, light transmitted through the tubular knitted fabric is received by the image pickup means. As a result, the multi-gradation image is picked up, in which boundaries between fiber areas and stitch areas of the tubular knitted fabric can be clearly discriminated, whereby the locations of the loop stitches can be more accurately detected.

Further, the penetration element may have a slit formed therein, and irradiating means for irradiating the slit.

According to the apparatus, light transmitted through the tubular knitted fabric arranged on the slit is also received by the image pickup means. As a result, the multi-gradation image is picked up, in which the boundaries between the fiber areas and the stitch areas of the tubular knitted fabric arranged on the slit can be clearly discriminated, whereby the locations of the loop stitches on the slit can be more accurately detected. Further, the same point needle can be inserted into the loop stitches on the frontward surface and backward surface of the knitted fabric, to thereby link the fabric.

Still further, the loop stitch detecting means comprise means for converting the multi-gradation image into a binary image, means for converting the binary image into a labeled image composed of labeled regions, region extracting means for counting the number of picture elements of each of the labeled regions present in the labeled image, and then extracting only labeled regions each having a larger number of picture elements than a predetermined value, the predetermined value being set to a value larger than a reference value corresponding to a minimum value of the number of picture elements forming a labeled region of each of the loop stitches in the labeled image, to thereby generate an extracted labeled image, and means for determining a location of each of the loop stitches by calculating a location of the labeled region of each of the loop stitches in the extracted labeled image.

According to the apparatus, the loop stitch is extracted based on an area of a loop stitch region, and then the location of the loop stitch is determined. As a result, the loop stitches and the stitches other than those can be discriminated, to thereby correctly determine the location of each loop stitch.

The means for converting the multi-gradation image into the binary image may include means for dividing the multi-gradation image into a plurality of small regions, and determining a binarization threshold value for each of the small regions, based on image features of each of the small regions.

In the apparatus, the image of each portion is binarized according to illumination of each portion of the tubular knitted fabric. As a result, the boundaries between the fiber areas and the stitch areas are detected irrespective of the influence of the illumination of each portion of the tubular knitted fabric, leading to further accurate detection of the loop stitches, whereby the locations of the loop stitches can be more accurately detected.

The means for guiding the point needle to the locations of the loop stitches may include means for moving the locations of the loop stitches in one direction, and means for moving the point needle in one direction orthogonal to the former direction. Further, the means for guiding the point needle to the locations of the loop stitches may include means for moving the point needle on a two-dimensional basis. Still further, the means for guiding the point needle to the locations of the loop stitches may include means for moving the locations of the loop stitches on a two-dimensional basis.

According to the apparatus, by moving the locations of the loop stitches and the location of the point needle, the point needle can be correctly guided to the locations of the loop stitches.

The above and other objects, features and advantages of the invention will become more apparent from the following detailed description taken in conjunction with the accompanying drawings.

BRIEF DESCRIPTION OF THE DRAWINGS

FIG. 9 is a diagram showing a binary image obtained by binarizing the multi-gradation image of FIG. 8;

FIG. 10 is a flowchart showing an example of a subroutine for carrying out binarization, which is executed at a step S5 in FIG. 7:

FIG. 11 is a diagram showing a labeled image obtained by label-processing the binary image of FIG. 9;

FIG. 12 is a diagram showing an image in which loop stitch regions are extracted based on the labeled image of FIG. 11;

DESCRIPTION OF THE PREFERRED EMBODIMENTS

Figure 1:
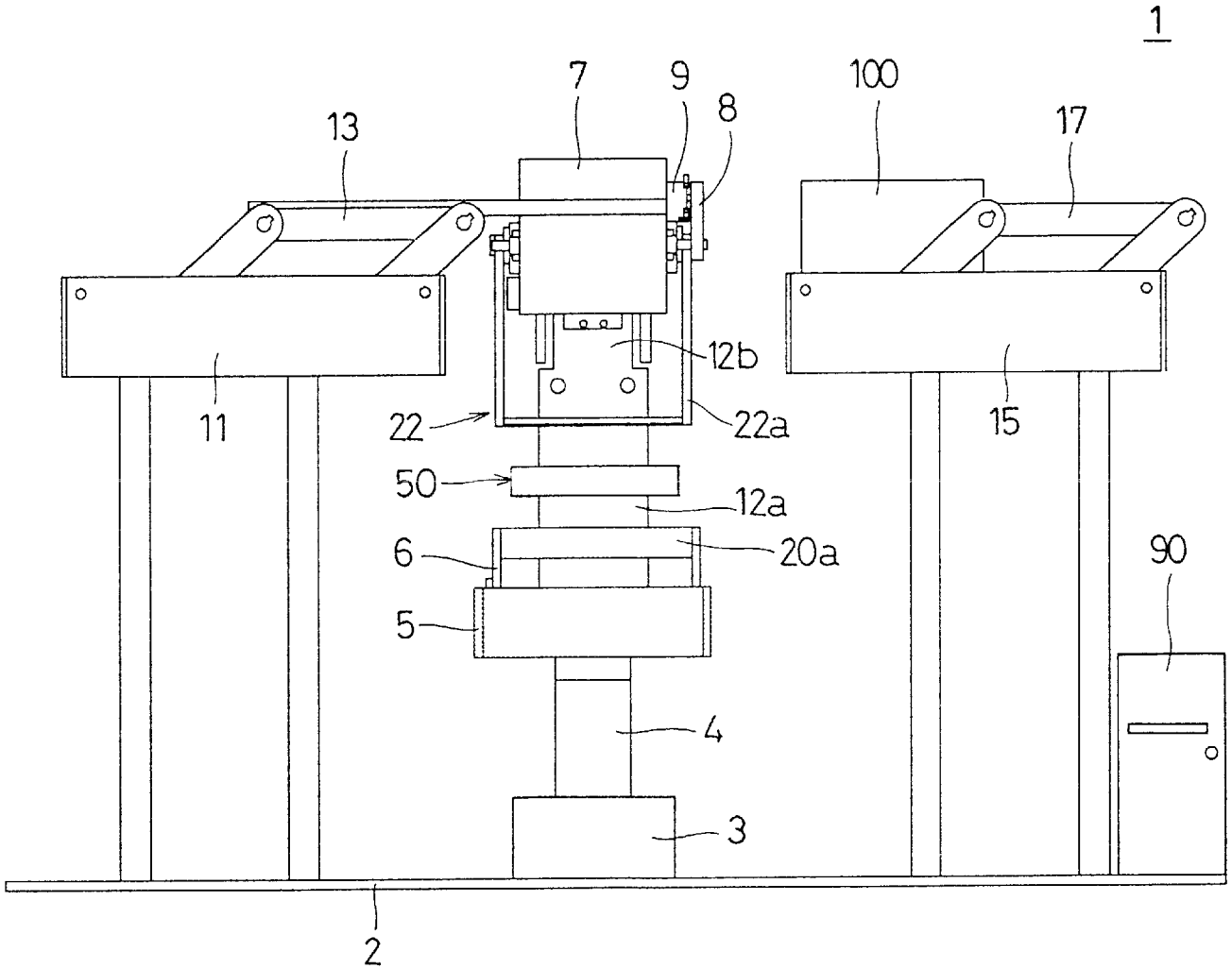
FIG. 1 is a schematic illustration showing the construction of a tubular knitted fabric-linking apparatus according to an embodiment of the invention.
Figure 2:
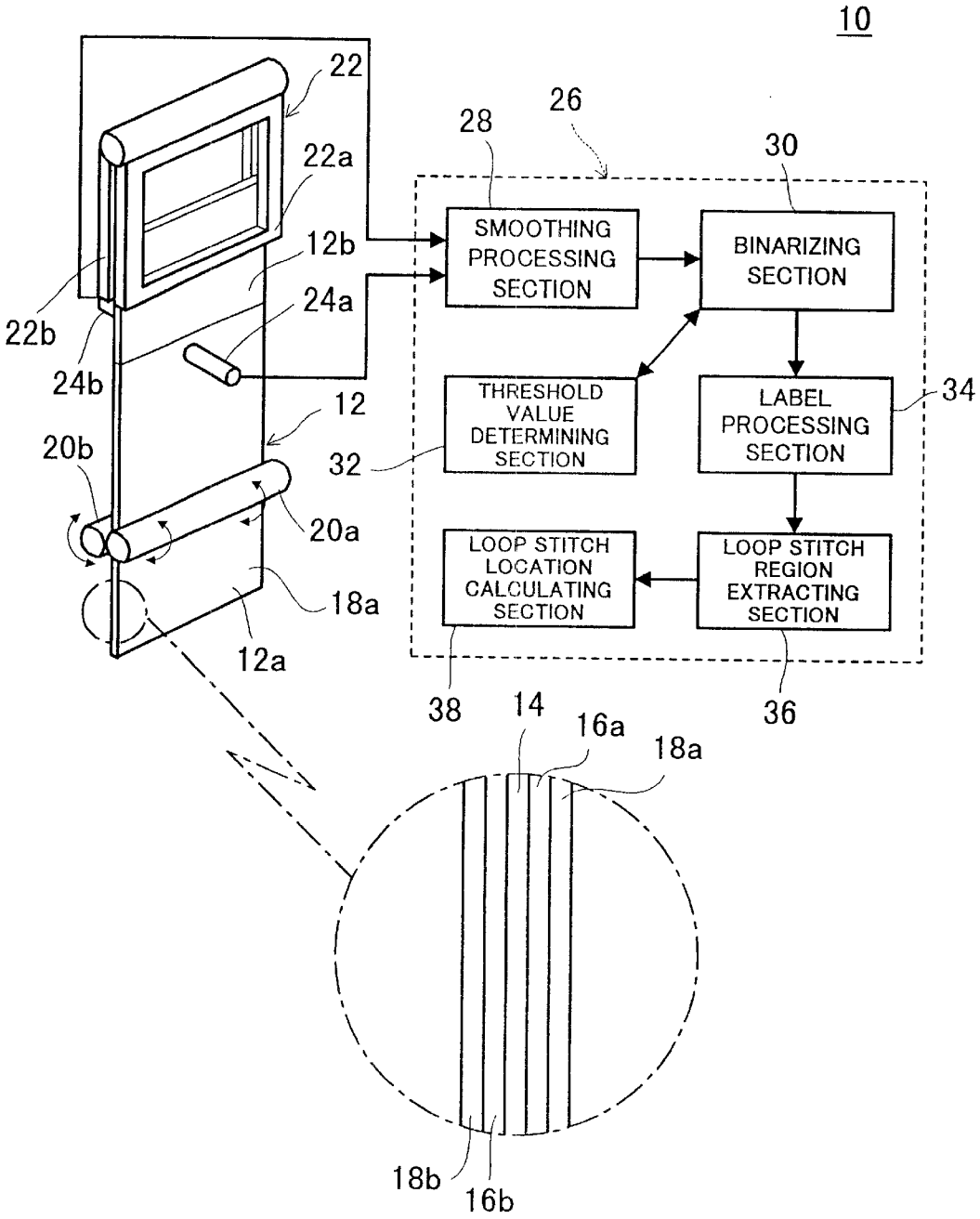
FIG. 2 is a schematic illustration showing the construction of a loop stitch detecting section which forms part of the tubular knitted fabric-linking apparatus of FIG. 1.
Figure 3:
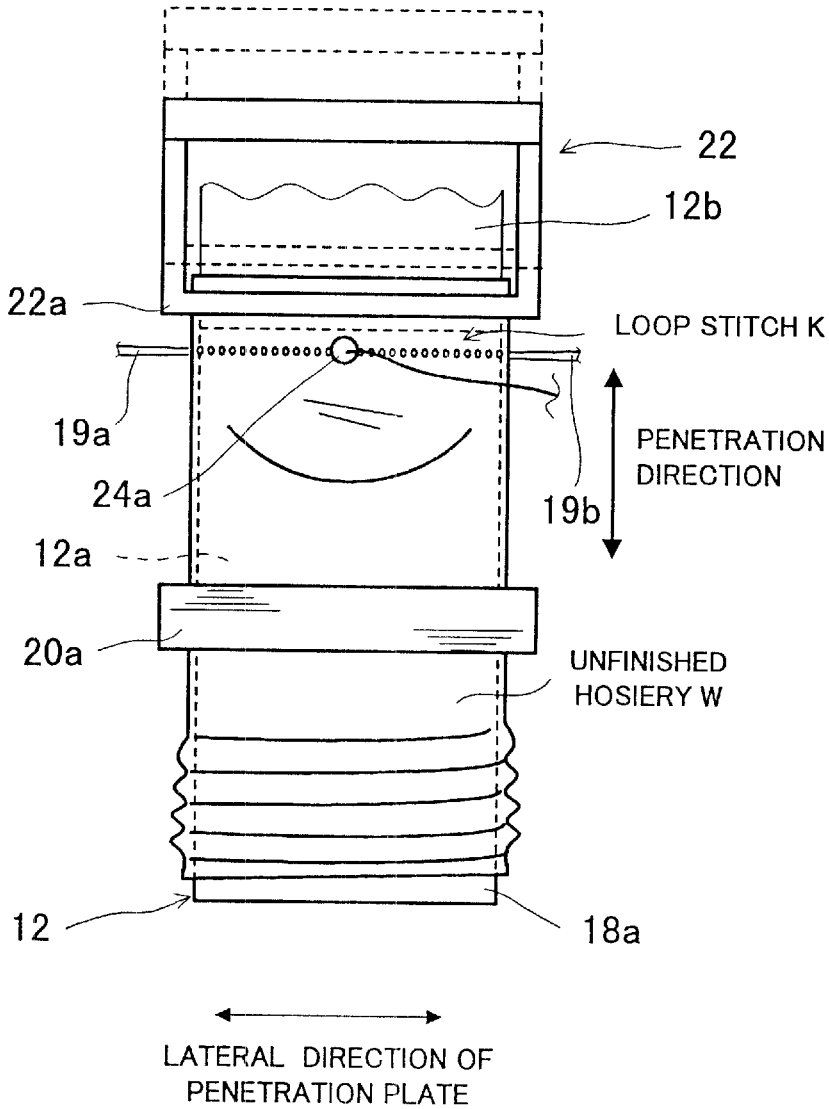
FIG. 3 is a diagram showing the essential part of the loop stitch detecting section on which a hosiery is fitted with a hem close to its toe left open.

Referring first to FIG. 1, there is schematically illustrated the construction of a tubular knitted fabric-linking apparatus according to an embodiment of the invention. FIG. 2 is a schematic illustration showing the construction of a loop stitch detecting section, and FIG. 3 is a diagram showing the essential part of the loop stitch detecting section on which a hosiery is fitted with a hem close to its toe portion left open.

In FIG. 1, reference numeral 1 designates a tubular knitted fabric-linking apparatus according to the embodiment. The apparatus 1 includes a bottom plate 2 on which a lower elevator 3 is set almost at the center thereof. The lower elevator 3 is constructed by combining a plate member, a cam and a drive motor, or alternatively by combining a plate member, a hydraulic jack, etc., such that the plate member forming an upper surface of the elevator 3 vertically moves. Formed on the upper surface of the elevator 3 is a cylindrical base 4 that has an appropriate length or height and is employed for providing a plurality of tubular knitted fabrics in a state of being penetrated thereby. A loop stitch detecting section 10 is arranged on an upper portion of the cylindrical base 4, the construction of which is shown in FIG. 2.

The loop stitch detecting section 10 comprises a lower penetration plate 12*a* and an upper penetration plate 12*b*, each of which is of a lengthy and flat shape. The lower and upper penetration plates 12*a* and 12*b* have the following construction: The lower and upper penetration plates 12*a* and 12*b* each have an intermediate plate formed of a material which will not be easily deformed, e.g. stainless steel. The intermediate plate 14 has its front and back surfaces laminated with EL (Electro Luminescence) panels 16*a* and 16*b* with light emitting surfaces thereof facing the outside. Further, the light emitting surfaces of the EL panels 16*a* and 16*b* are laminated with transparent plates 18*a* and 18*b*, e.g. transparent acrylic plates, such that the entire light emitting surfaces are covered for protection of the EL panels 16*a* and 16*b*. Thus, the lower and upper penetration plates 12*a* and 12*b* are formed.

The EL panels 16*a* and 16*b* are electrically connected to an operation power supply (not shown) such that appropriate voltage is applied thereto to arbitrarily emit light. Although in the present embodiment, the EL panels are employed as light emitting means, this is not limitative. Alternatively, the light emitting means may be any one that has a light emitting function. However, in taking into consideration of a process at an image processor 26, referred to hereinafter, it is desirable to employ an emitter of a surface emission type, such as the EL panels employed in the present embodiment, plasma display panels, or the like, in order to prevent the brightness of the light emitting means from being nonuniform at any portion of the surfaces of the lower and upper penetration plates 12*a* and 12*b*.

As shown in FIG. 3, the lower and upper penetration plates 12*a* and 12*b* function to arrange a hosiery W which is a tubular knitted fabric and has a hem close to its toe portion left open (hereinafter simply referred to as "the unfinished hosiery W"), etc. by penetrating the same. The lower and upper penetration plates 12*a* and 12*b* each have a size such that at least a portion of the knitted fabric, in which loop stitches K of the unfinished hosiery W are formed, is extended and enlarged when the unfinished hosiery W is fitted thereon. In other words, at least a portion of each of the lower and upper penetration plates 12*a* and 12*b*, on which the loop stitches K are arranged, should be larger in width than the unfinished hosiery W which is in a state of being flatly spread with one side thereof being stuck to the other without a gap between the two. Further, to hold the loop stitches K at the same height, the lower penetration plate 12*a* has hooks 19*a* and 19*b* on both side edges thereof, for hooking the loop stitches K placed corresponding, respectively, to the side edges. To smoothly feed the unfinished hosiery W and to move the same from the lower penetration plate 12*a* to the upper penetration plate 12*b*, it is desirable that neither the lower penetration plate 12*a* nor the upper penetration plate 12*b* has a portion, such as a projection, at which the external shape thereof sharply varies.

The lower penetration plate 12*a* has a front surface and a back surface, on which are arranged rollers 20*a* and 20*b* as lower retaining means at respective lower portions of the surfaces, symmetrically with respect to the lower penetration plate 12*a*. As shown in FIG. 3, the rollers 20*a* and 20*b* roll on the fabric at a portion lower than the loop stitches K while pressing the unfinished hosiery W toward the penetration plate 12*a*, to thereby move the unfinished hosiery W in a penetration direction. The rollers 20*a* and 20*b* are driven by driving means, such as a motor equipped with an encoder, so that they roll in an arbitrary amount. To facilitate the operation of fitting the unfinished hosiery W on the lower penetration plate 12*a*, a frame portion 5 (see FIG. 1) is provided in the vicinity of the lower penetration plate 12*a*, which portion has an arm 6 set in a mobile manner. Thus, the arm 6 supports both ends of shafts of the rollers, to thereby enable to space the rollers from the surfaces of the penetration plate 12*a* during fitting of the unfinished hosiery W.

Further, the upper penetration plate 12*b* has a front surface and a back surf ace, on which are arranged retaining arms 22*a* and 22*b* at upper portions of the surfaces, respectively, such that the front surface and the back surface are widthwise retained by closing the arms 22*a* and 22*b*. The arms 22*a* and 22*b* form an upper retaining section 22. As shown in FIG. 3, the upper retaining section 22 functions to retain the unfinished hosiery W at a location upper than the loop stitches K, to thereby move the hosiery W in the penetration direction. The upper retaining portion 22 is supported by an upper elevator 7 that is constructed so as to arbitrarily change its supporting position. The penetration plate 12*b* is secured to a bottom surface of the upper elevator 7 so as not to interlock the motion of the upper retaining section 22. The retaining arms 22*a* and 22*b* are constructed so as to arbitrarily open and close by a rotational force of the rotation axes thereof applied via a belt 8 driven by a motor 9. Further, a stand 11 having an arm 13 formed thereon is placed adjacent to the lower elevator 3, and the upper retaining section 22, the upper penetration plate 12*b*, etc. can be laterally moved by means of the arm 13.

Still further, CCD cameras 24*a* and 24*b* are provided in the vicinity of the lower and upper penetration plates 12*a* and 12*b*, respectively, such that image pickup directions thereof are set at right angles with respect to the surfaces of the lower and upper penetration plates 12*a* and 12*b*, respectively. The CCD cameras 24*a* and 24*b* pick up, at close range, multi-gradation images including images of all loop stitches K of the unfinished hosiery W fitted on the lower and upper penetration plates 12*a* and 12*b*. The multi-gradation images picked up by the CCD cameras 24*a* and 24*b* are input into the image processor 26 by suitably switching the images, depending on locations of the loop stitches to be detected. In the present embodiment, the image pickup direction of the CCD cameras 24*a* and 24*b* are set at right angles with respect to the surfaces of the lower and upper penetration plates 12*a* and 12*b*, respectively, but this is not imitative. Alternatively, the setting of the CCD cameras may properly be changed insofar as the image of the stitches inclusive of the loop stitches K of the unfinished hosiery W can be clearly picked up.

The CCD cameras 24 and 24*b* are electrically connected to the image processor 26 provided in a control section 90 (see FIG. 1). The image processor 26 detects the loop stitches K formed in the unfinished hosiery W, based on the multi-gradation images picked up by the CCD cameras 24*a* and 24*b*. The image processor 26 comprises a smoothing processing section 28 for smoothing processing the multi-gradation image, a binarizing section 30 for binarizing the multi-gradation image, a threshold value determining section 32 for determining a binarization threshold value for use in binarization, a label processing section 34 for converting the binarized image into a labeled image, a loop stitch region extracting section 36 for extracting loop stitch regions, based on the number of picture elements forming each labeled region present in the labeled image, to thereby generate an extracted labeled image, and a loop stitch location calculating section 38 for calculating the location of each loop stitch region present in the extracted labeled image. The function of each of the sections will be described in detail hereinafter with reference to the operation of the tubular knitted fabric-linking apparatus 1 that links the unfinished hosiery W.

Figure 4:
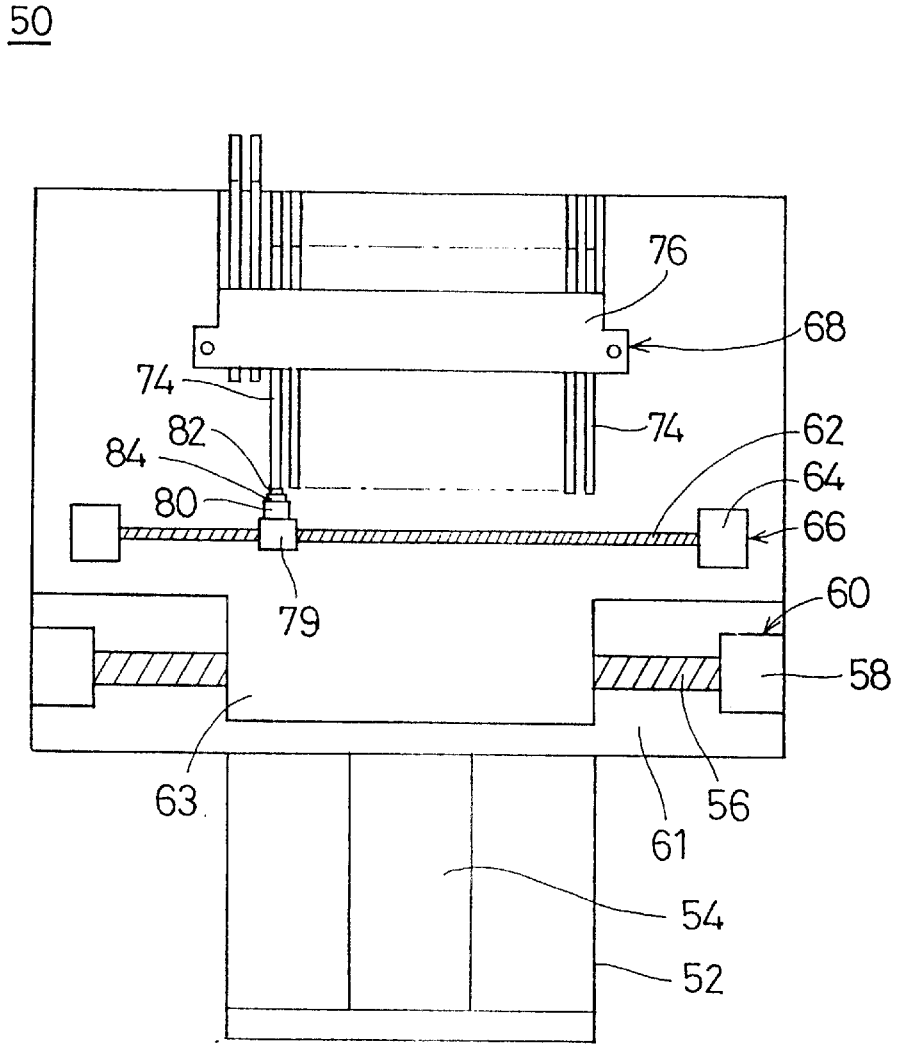
FIG. 4 is a schematic illustration showing the construction of a point needle control unit.

Next, description will be made of a point needle control unit with reference to FIGS. 4 to 6. FIG. 4 is an illustration schematically showing the construction of the point needle control unit designated by reference numeral 50, FIG. 5 a plan view showing the construction of a point needle 62 appearing in FIG. 4, and FIG. 6 a perspective view of a needle 74 appearing in FIGS. 4 and 5.

The point needle control unit 50 is arranged in a relation facing to a frontward side of the frame portion 5 and upper than the same. The point needle control unit 50 includes a conveyer 52, as shown in FIG. 40, which has a belt 54 and is secured to the unit 50 so as to horizontally move the belt 54 to and fro. Further, a point needle lateral location control section 60 composed of a feed screw 56 and a feed motor 58 is attached onto the belt 54 via a plate 61. In the present embodiment, the feed screw 56 is horizontally attached to the plate 61. Further attached to the feed screw 56 is another plate 63 in a laterally mobile manner. The plate 63 is arranged in the vicinity of the lower penetration plate 12*a* and has a needle thrust control section 66 secured on a frontward surface thereof as viewed in the figure. The section 66 is composed of a feed screw 62 and a feed motor 64. Still further, a point needle 66 is attached to a backward end portion of the plate 63 in a facing relation to an upper end of the lower penetration plate 12*a*. The point needle 68 has almost the same width as the width of the lower penetration plate 12*a*.

Figure 5:
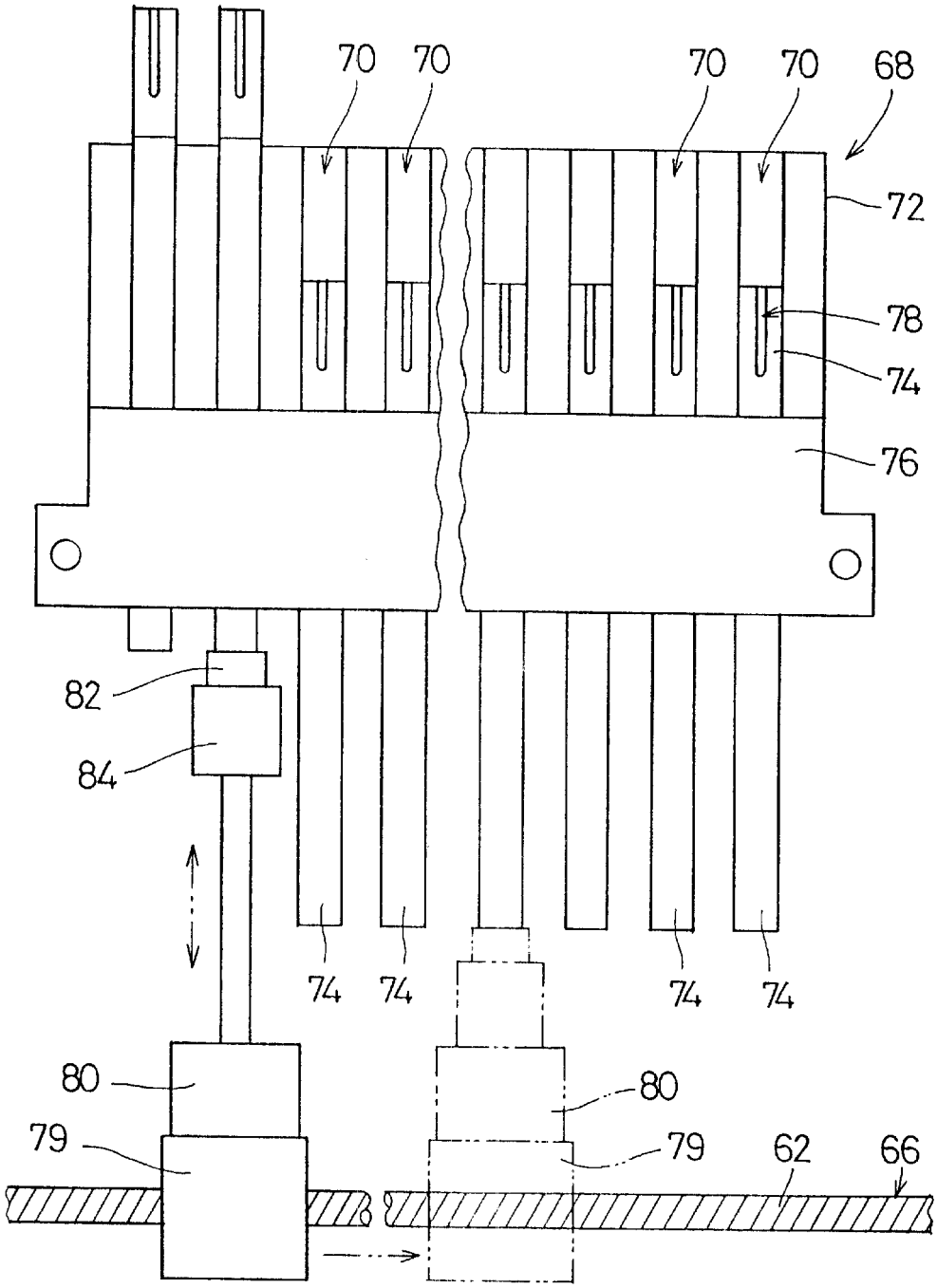
FIG. 5 is a plan view showing the construction of a point needle appearing in FIG. 4.
Figure 6:
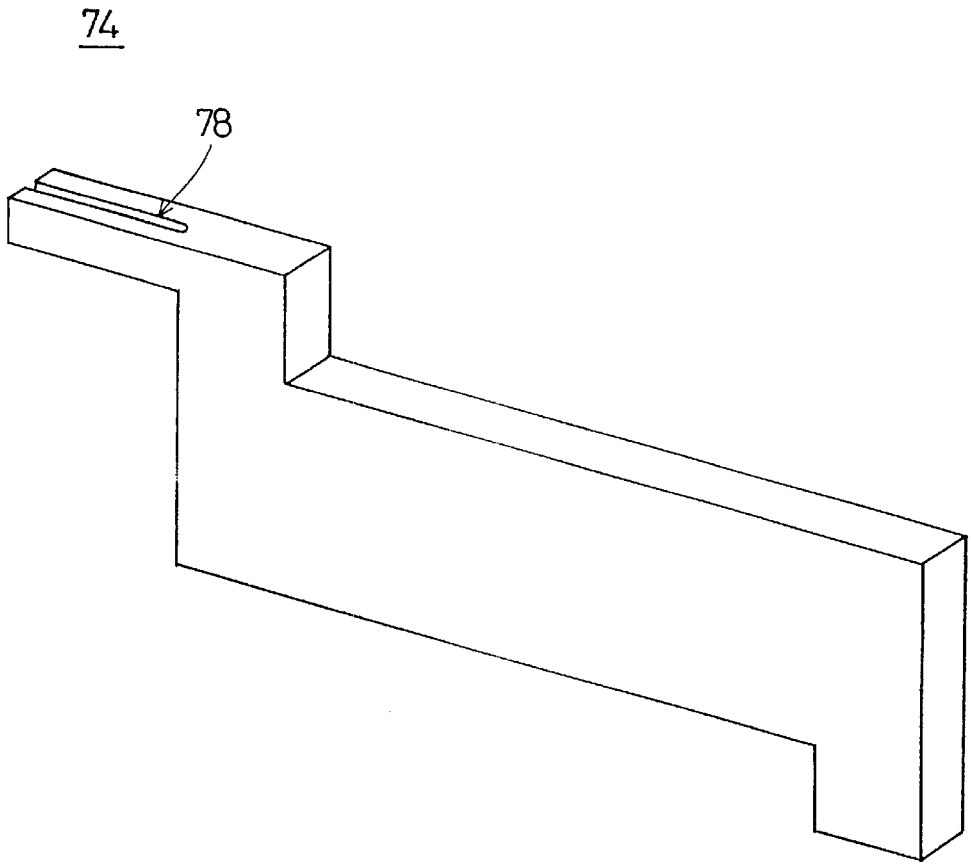
FIG. 6 is a perspective view showing a needle appearing in FIGS. 4 and 5.

As shown in FIG. 5 in particular, the point needle 68 comprises a sheath 72 having a comb-shaped longitudinal sectional view defined by a plurality of grooves 70 arranged therein at regular intervals, a plurality of needles 74 accommodated in the grooves 70 in a manner of freely thrusting and pulling to and fro, and a cover 76 covering part of a frontward portion of an upper surface of the sheath 72. As shown in FIG. 6 in particular, the needle 74 has its frontward end portion formed in the L shape, and is engaged with a frontward end surface of the sheath 72 when thrust backward. Further, the needle 74 has a step-wise level difference at a backward end portion thereof, which level difference is engaged with the cover 76 when pulled again frontward. Still further, the needle 74 has a guide groove 78 formed in an upper surface of the backward end portion, for guiding a needle of a sewing machine 100, referred to hereinafter. The hooks 19*a* and 19*b* also have guide grooves, similar to the guide groove 78, at tip portions thereof, respectively.

Screwed onto the feed screw 62 of the needle thrust control section 66 is a female screw member 79, as shown in FIG. 5. A block thrusting/pulling section 80 is secured to the female screw member 79. The section 80 has a solenoid for generating a force to thrust the needle 74. Further, a block 84 having a needle thrusting pin 82 is attached to the block thrusting/pulling section 80 on a surface thereof facing the point needle 68.

With the construction described above, the point needle control unit 50 can change the to-and-fro location of the point needle 68 by driving the conveyer 52. Further, the unit 50 can change the lateral location of the point needle 68 by driving the point needle lateral location control section 60. Still further, each of the needles 74 can be thrust one by one, by intermittently driving the needle thrust control section 66 and the block thrusting/pulling section 80. The conveyer 52, the point needle lateral location control section 60, the needle thrust control section 66, and the block thrusting/pulling section 80 are electrically connected to the control section 90 (see FIG. 1), whereby the needle 74 of the point needle 68 can be guided to the location of the loop stitch detected by the loop stitch detecting section 10 and be thrusted to the loop stitch.

Further, the tubular knitted fabric-linking apparatus 1 according to the embodiment includes the sewing machine 100 that links the loop stitches by using the guide grooves 78 of the needles 74 of the point needle 68 that are inserted into the loop stitches. The sewing machine 100 is constructed so as to be laterally mobile by means of an arm 17, etc. formed on another stand 15 located next to the lower elevator 3.

Figure 7:
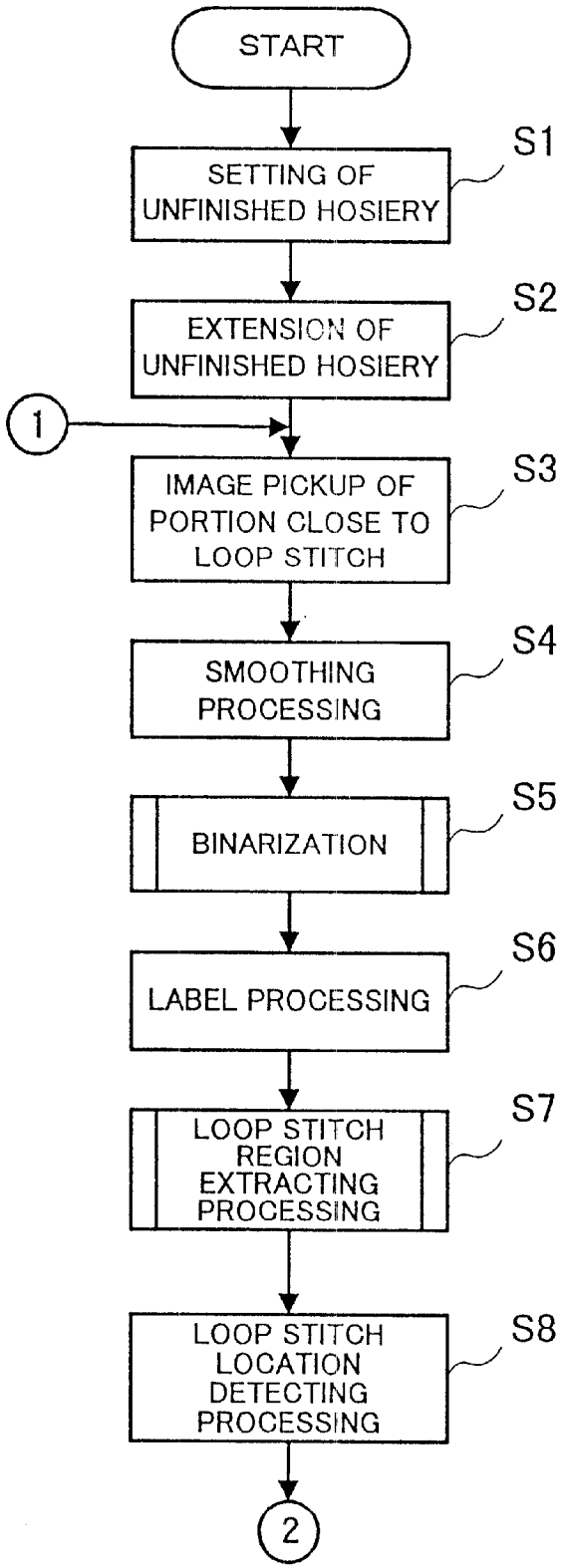
FIG. 7 is a flowchart showing an example of a main routine for operating the tubular knitted fabric-linking apparatus according to the embodiment.

Next, description will be made of the operation of the tubular knitted fabric-linking apparatus that links the unfinished hosiery W, mainly with reference to FIG. 7. FIG. 7 is a flowchart showing an example of a main routine for operating the tubular knitted fabric-linking apparatus.

First at a step S1, the unfinished hosiery W is set to the loop stitch detecting section 10. The setting operation is as follows: First, the unfinished hosiery W is inserted into and fit on the lower and upper penetration plates 12*a* and 12*b*. At this time, the hooks 19*a* and 19*b* are inserted into the loop stitches K placed on both the side edges of the unfinished hosiery W, which enables to laterally extend the unfinished hosiery W. Then, as shown in FIG. 3, the unfinished hosiery W is retained by the retaining arms 22*a* and 22*b* of the upper retaining section 22 at the portions upper than the loop stitches K, and is further retained by pressing the rollers 20*a* and 20*b* to the lower penetration plate 12*a* at the portions lower than the loop stitches K.

At a step S2, the unfinished hosiery W is extended in the penetration direction by means of the upper retaining section 22 and the rollers 20*a* and 20*b*. The extension is carried out, as shown in FIG. 3, by moving the upper retaining section 22 upward to raise its supporting location, by rolling the rollers 20*a* and 20*b* downward to pull down the unfinished hosiery W, or by carrying out both the operations mentioned above. During the extension, it should be taken into consideration that the loop stitches K fall in a range where the CCD cameras 24*a* and 24*b* can pick up their image.

The results of the operations at the steps S1 and S2 will be as follows: The stitches of the unfinished hosiery W are enlarged both in the width direction of the lower and upper penetration plates 12*a* and 12*b* and the penetration, direction of the unfinished hosiery W, and therefore the loop stitches K can be easily detected by the image processor 26. In the present embodiment, at the step 52, the unfinished hosiery W is extended in the penetration direction by means of the rollers 20*a* and 20*b* and the upper retaining section 22. However, if the unfinished hosiery W is suitably extended in the penetration direction due to friction generated between the unfinished hosiery W and the penetration plates 12*a* and 12*b* at the step S1, the step S2 may be omitted.

Figure 8:
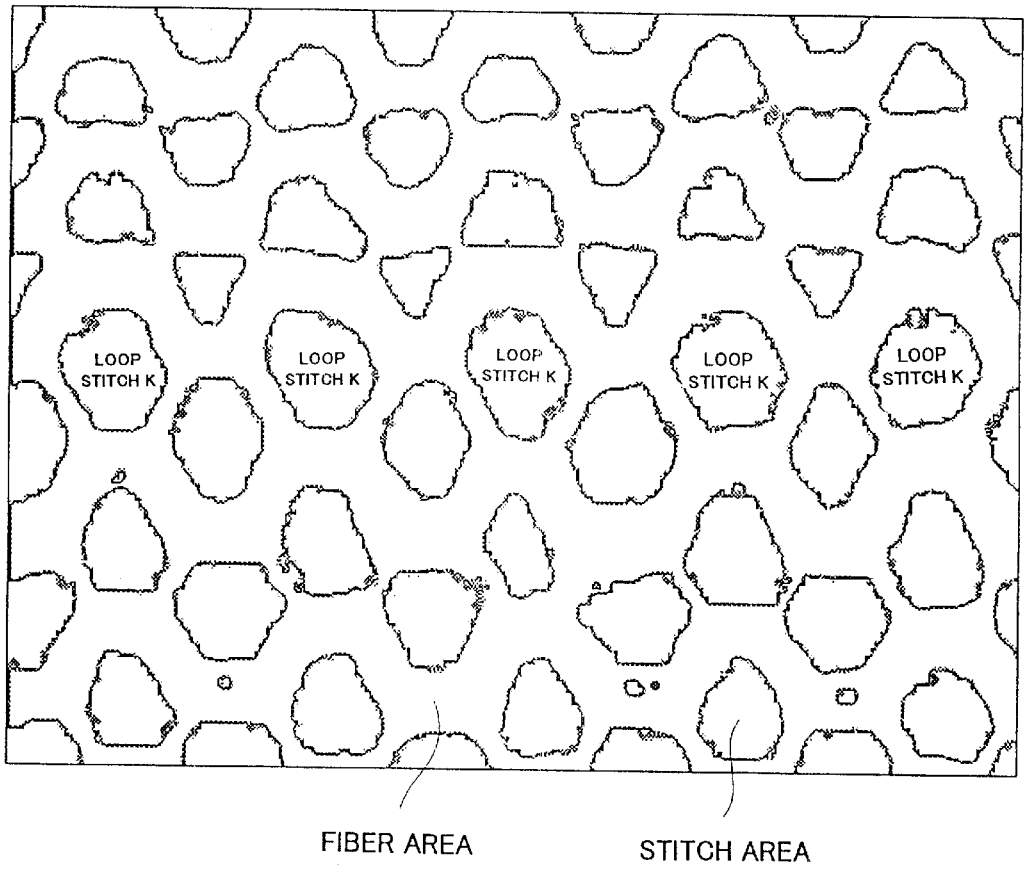
FIG. 8 is a diagram showing part of a multi-gradation image, which is picked up by a CCD camera 24*a* or 24*b* appearing in FIG. 2.

Next, at a step S3, the image of the stitches inclusive of the loop stitches K formed in the unfinished hosiery W is picked up by the CCD cameras 24*a* and 24*b*. FIG. 8 is a diagram showing part of the multi-gradation image of the stitches, picked up by the CCD camera. At the time of image pickup, the EL panels 16*a* and 16*b* of each of the lower and upper penetration plates 12*a* and 12*b* are lighted on, and in order to clearly discriminate boundaries between fiber areas and stitch areas of the unfinished hosiery W, transmitted light is employed to pick up the image by means of the CCD cameras 24*a* and 24*b*.

Then, at a step S4, the picked-up multi-gradation image is input into the smoothing processing section 28 of the image processor 26 to thereby convert the image into a smoothing-processed multi-gradation image. The smoothing processing section 28 functions to remove noise contained in the multi-gradation image picked up by the CCD cameras 24 and 24*b*, to thereby convert the image into one which is free from fine fluctuations in the density gradation at every picture element. By executing the smoothing processing, the multi-gradation image becomes one in which the boundaries between the fiber areas and the stitch areas of the unfinished hosiery W can be more clearly discriminated. Smoothing filters for use in the smoothing processing may include a simple averaging filter which calculates an average value of the gradation of a noted picture element and picture elements therearound and then replaces the value of the noted picture element with the average value, a filter using the moving average method, etc.

At a step S5, the smoothing-processed multi-gradation image is input into the binarizing section 30, at which binarization is executed to convert the image into a binary image. FIG. 9 is a diagram showing the binary image obtained by binarizing the multi-gradation image shown in FIG. 8.

The binarization will be described in detail with reference to FIG. 10. FIG. 10 is a flowchart showing an example of a subroutine for carrying out the binarization. First, at a step S51, the multi-gradation image is divided into small regions each having the same area. At the time of dividing the image, the small regions may be overlapped with each other in a predetermined proportion.

Then, at a step S52, a binarization threshold value of each small region is determined based on density histogram of each small region. Interpolation of the threshold value between the small regions can make it possible to obtain a more smoothed and more suitable binarization threshold value. In the present embodiment, the P-title method is used for determining the threshold value, but any other threshold value-determining method such as the mode method or the discriminatory analyzing method may be used. Further, if fluctuations in illumination of the unfinished hosiery W is small and frequent change in the binarization threshold value is not necessary, the present step S52 may first be executed to store the obtained binarization threshold value, whereby the stored value is used for the binarization of the input image obtained in the subsequent binarization.

At a step S53, which is the last step of the binarization, the multi-gradation image is converted into the binary image. In the binarization, the conversion of the image is executed based on the binarizatlon threshold value of each small region determined by the threshold value determining section 32. In the present embodiment, the binary image is formed, as shown in FIG. 9, by allotting a picture signal "0" to a portion forming the fiber area, i.e. to a picture element with high density gradation, and a picture signal "1" to a portion forming the stitch area, i.e. to a picture element with low density gradation, respectively.

Referring again to FIG. 7, at a step 56, the binary image is converted into a labeled image by the label processing section 34. FIG. 11 is a diagram showing the labeled image obtained by label processing the binary image of FIG. 9. In the present embodiment, by converting the binary image into the labeled image shown in FIG. 11, the picture element of the portion forming the fiber area assumes "0" without allotment of a label. On the other hand, to the stitch areas inclusive of the loop stitch K areas, labels such as letters and symbols other than "0" are allotted, to thereby form labeled regions. As is apparent from comparison between FIGS. 9 and 11, labels of "c", "d", "e", "f", and "g" are allotted to the regions indicative of the loop stitches K.

At a step S7, labeled regions indicative of the loop stitches K (hereinafter simply referred to as "the loop stitch regions") are extracted by the loop stitch region extracting section 36. FIG. 12 is a diagram showing an image in which the loop stitch regions are extracted based on the labeled image of FIG. 11.

Figure 13:
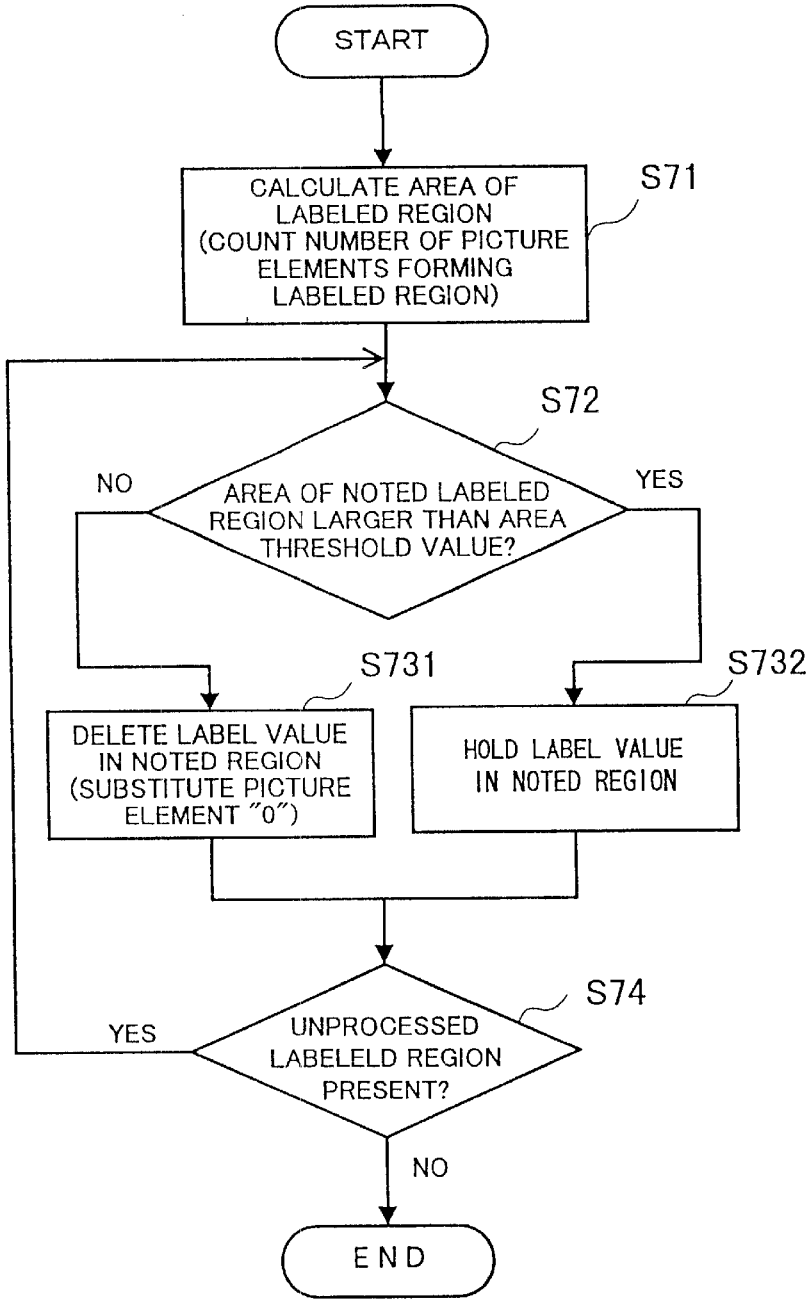
FIG. 13 is a flowchart showing an example of a subroutine for carrying out loop stitch extracting processing, which is executed at a stop S7 in FIG. 7.

The loop stitch extracting processing at the step S7 will be described in detail with reference to FIG. 13. FIG. 13 is a flowchart showing an example of a subroutine for carrying out the loop stitch extracting processing. First, at a step S71, the number of picture elements forming each of the labeled regions (hereinafter simply referred to as "the area") present in the labeled image is counted.

Then, at a step S72, the area of each labeled region is compared with an area threshold value set beforehand, and if the area of a noted labeled region is smaller than the area threshold value, the program proceeds to a step S731, wherein the label value of the noted region is deleted, followed by inputting a value "0" into the picture elements forming the region, On the other hand, if the area of the noted labeled region is larger than the area threshold value, the program proceeds to a step S732, wherein the label value of the noted region is held as it is. The area threshold value is set as follows: When the image of the loop stitches K is binarized and then label-processed, the minimum value of the number of picture elements forming the labeled region of the loop stitch is determined as a reference value. The threshold value is set to a value slightly smaller than the reference value. In the embodiment, the area threshold value is set to 12.

At the following step S74, it is determined whether or not unprocessed labeled regions are present. In this manner, the labeled regions are all processed by executing the steps S72 to S74.

Referring again to FIG. 7, at a step S8, the location of the loop stitch is detected by calculating the location of the loop stitch region by the loop stitch location calculating section 38. In the embodiment, the calculation is made by regarding the location of the gravity center of the loop stitch region as the location of the loop stitch.

Figure 14:
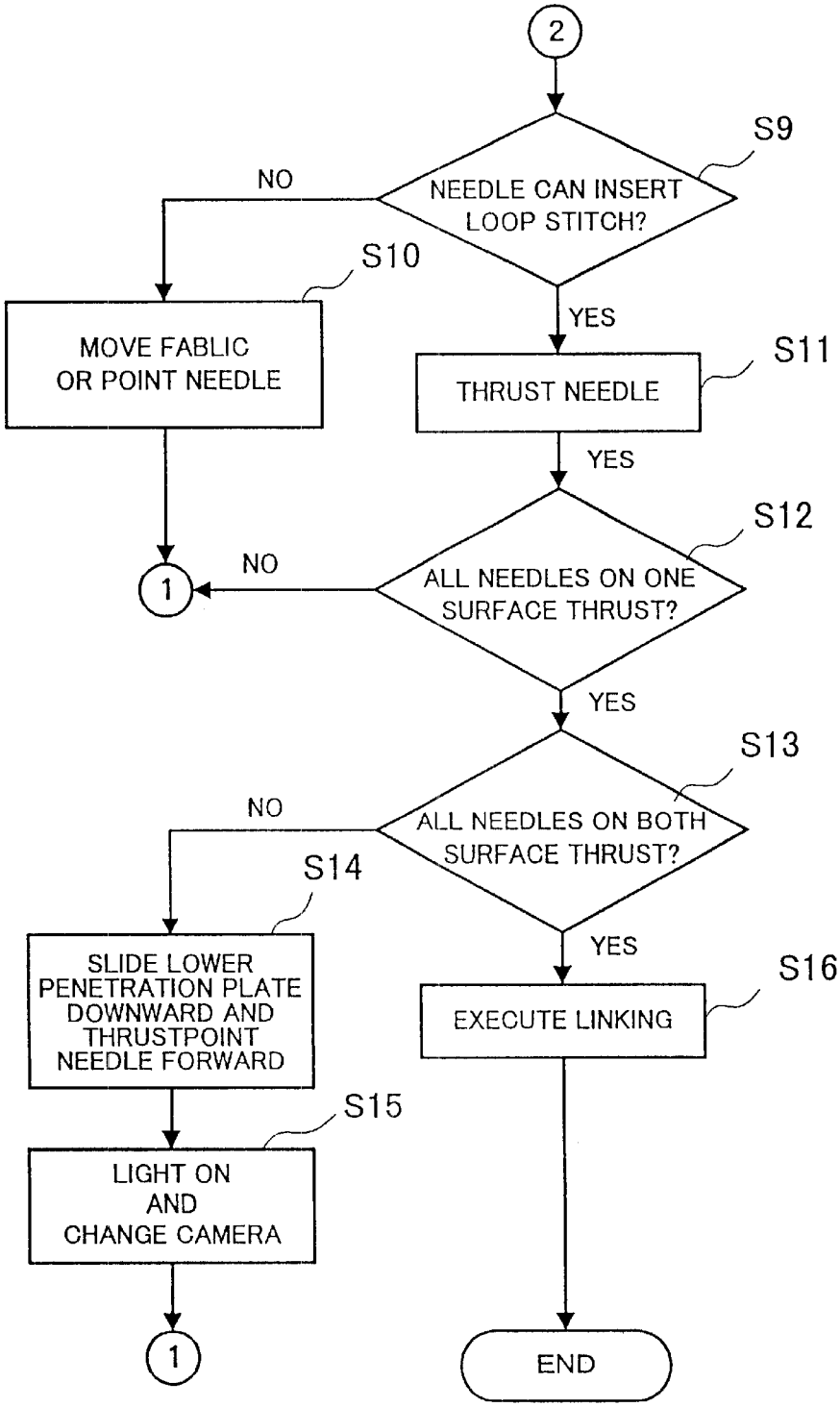
FIG. 14 is a continued part of the flowchart of the FIG. 7 main routine for inserting a point needle into a loop stitch.

Then, at a step S9 in FIG. 14, it is determined whether or not the needle 74 can be inserted into the loop stitch K, based on the detected location of the loop stitch and the location of the needle 74.

Figure 15:
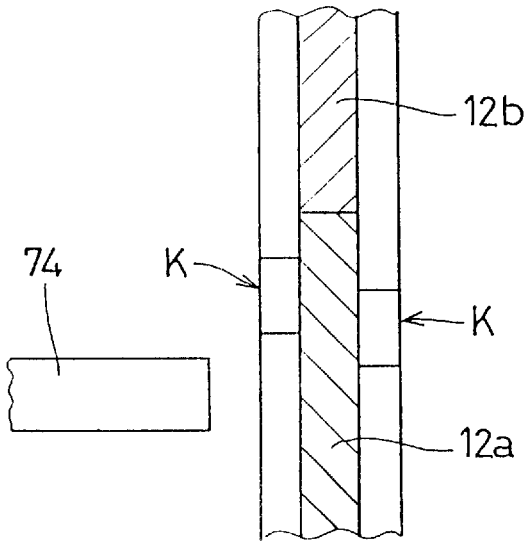
FIG. 15 is a schematic side view showing a loop stitch arranged on one surface of lower and upper penetration plates appearing in FIGS. 1, 2 and 3 and the needle of FIG. 6, in which the former does not correspond to the location of the latter.

If the needle 74 is vertically shifted with respect to the detected location of the loop stitch K, as shown in FIG. 15, and hence the needle 74 cannot be inserted into the loop stitch K, the program proceeds to a step S10. At the step S10, the fabric is moved along the lower and upper penetration plates 12*a* and 12*b* by means of the rollers 20*a* and 20*b*, and the point needle 68 is moved in the direction orthogonal to the direction of moving the fabric, whereby the needle 74 is adjusted to a location corresponding to the loop stitch K. On the other hand if the needle 74 is horizontally shifted with respect to the detected location of the loop stitch X, the point needle 68 is horizontally moved by controlling the point needle lateral location control section 60, whereby the needle 74 is adjusted to the location corresponding to the loop stitch K.

If the adjustment is carried out at the step S10, the program returns to a recursive point 1, and the location of the loop stitch is detected again. If the needle 74 cannot be guided to the location corresponding to the loop stitch K in one execution of the program, the adjustment mentioned above is repeatedly carried out several times.

Figure 16:
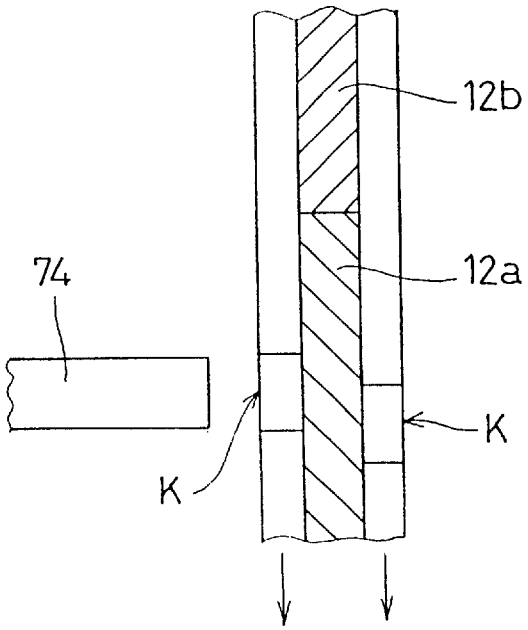
FIG. 16 is a schematic side view showing the loop stitch on the one surface of the penetration plates and the needle, in which the former is guided to the location of the latter.
Figure 17:
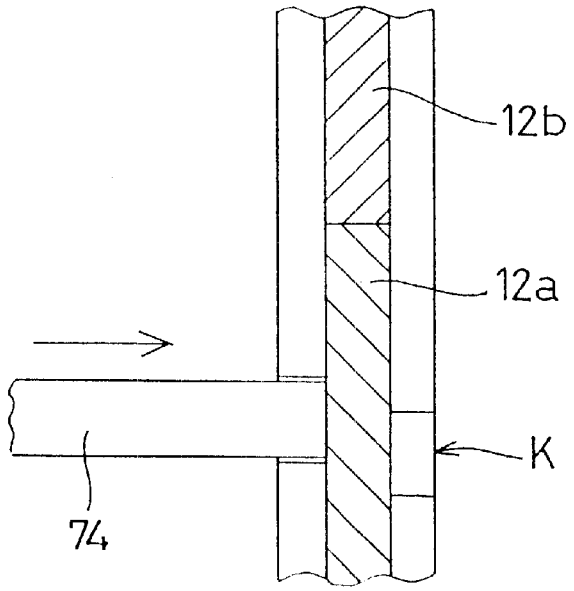
FIG. 17 is a schematic side view showing the loop stitch on the one surface of the penetration plates and the needle, in which the latter is inserted into the former.

When the needle 74 is guided to the location corresponding to one of the loop stitches by executing the adjustment, as shown in FIG. 16, the needle 74 is thrust by the block thrusting/pulling section 80 at a step S11. Then, as indicated in FIG. 17, the needle 74 is inserted into the loop stitch K of the fabric, and stopped by making contact with one surface of the lower penetration plate 12*a*.

At a step S12, it is determined whether or not the thrusting of the needle 74 has been carried out with respect to all the loop stitches K arranged on the one surface of the lower penetration plate 12*a*. If the thrusting has not been carried out with respect to the entire loop stitches K on the one surface, the program returns to the recursive point 1. On the other hand, if the thrusting has been carried out with respect to all the loop stitches K on the one surface, the program proceeds to a step S13.

At the step S13, it is determined whether or not the process at the step S11 has been carried out with respect to all the loop stitches K on both the surfaces of the lower penetration plate 12*a*. If the needles 74 have not been thrust all the loop stitches K on both the surfaces, the program proceeds to a step S14.

Figure 18:
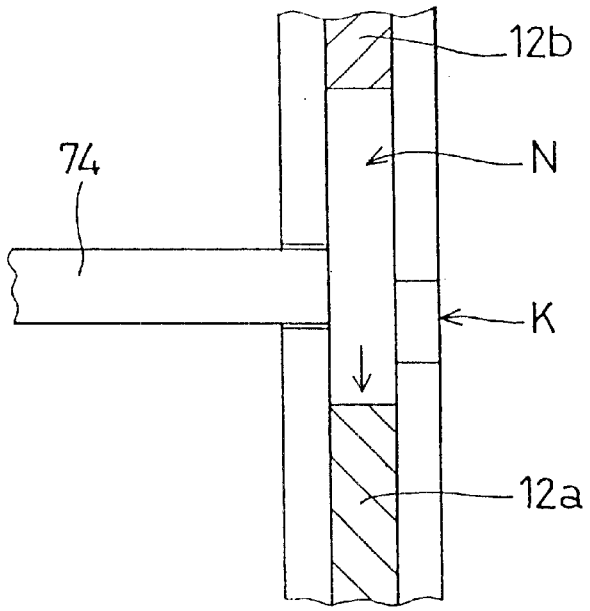
FIG. 18 is a schematic side view showing the loop stitch on the one surface of the penetration plates and the needle, in which the lower penetration plate slides downward to form a slit between the lower and upper penetration plates.
Figure 19:
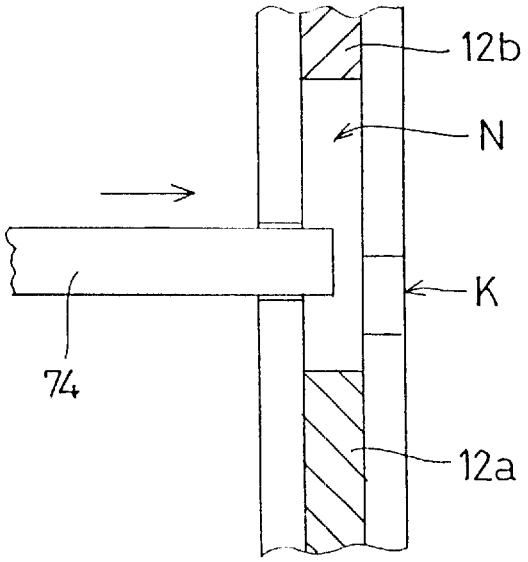
FIG. 19 is a schematic side view showing the loop stitch on the one surface of the penetration plates and the needle, in which the needle is positioned in the slit between the lower and upper penetration plates.

At the step S14, as shown in FIG. 18, the lower penetration plate 12*a* slides downward, to thereby form a slit N between the lower and upper penetration plates 12*a* and 12*b*. On this occasion, to prevent the needle 74 from slipping out of the loop stitch of the fabric, the point needle 68 is slightly thrust forward by the conveyer 52, as shown in FIG. 19, whereby the needle 74 is positioned in the slit N. Further, a light, not shown, arranged in the vicinity of the slit N is lighted, and the camera to pick up the image is changed from the CCD camera 24*a* to the CCD camera 24*b*, followed by the program returning to the recursive point 1.

In many cases, however, even if the slit N is formed between the lower and upper penetration plates 12*a* and 12*b*, the needle 74 does not correspond to a location of the loop stitch K on the other surface of the penetration plates, as shown in FIGS. 18 and 19. To cope with these cases, the loop stitch K is detected by the loop stitch detecting section 10 on the other side of the penetration plates. Similarly to the manner of detecting the loop stitch on the one surface of the penetration plates 12*a* and 12*b*, the needle 74 is adjusted to the location of the loop stitch K of the fabric on the other surface of the penetration plates 12*a* and 12*b*. The fabric is moved by the rollers 20*a* and 20*b*, and therefore it is moved on both the surfaces of the penetration plates. On the one surface of the penetration plates, however, the needle 74 is inserted into the loop stitch K, so that the fabric is not moved so much on the one surface of the penetration plates 12*a* and 12*b*, to thereby prevent the needle 74 from slipping out of the loop stitch K.

Figure 20:
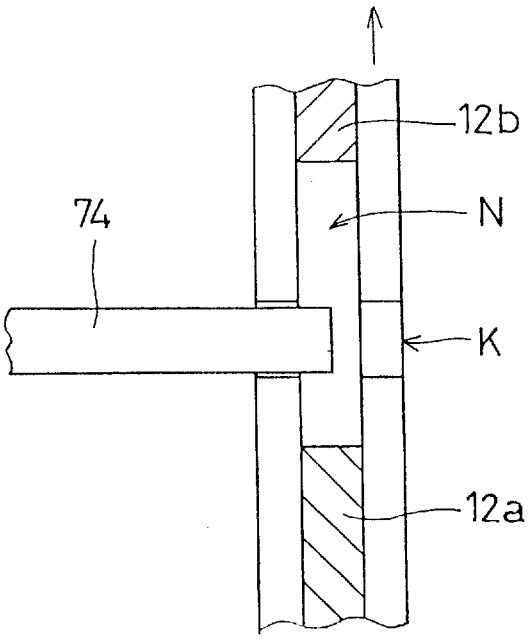
FIG. 20 is a schematic side view showing the loop stitch on the other surface of the penetration plates and the needle, in which the former is guided to the location of the latter.
Figure 21:
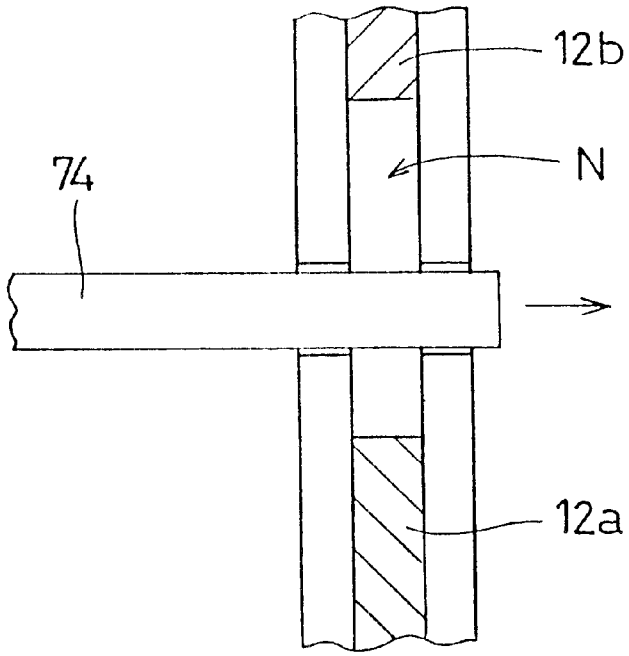
FIG. 21 is a schematic side view showing the loop stitch on the other surface of the penetration plates and the needle, in which the needle is inserted into the loop stitches on both the surfaces of the penetration plates.

By carrying out the adjustment described as above, when the needle 74 is guided to the location of the loop stitch K of the fabric on the other surface of the penetration plates 12*a* and 12*b*, as shown in FIG. 20, the needle 74 is further thrust by the block thrusting/pulling section 80. Thus, as shown in FIG. 21, the single needle 74 is inserted into the loop stitches K of the fabric arranged, respectively, on the one surface and the other surface of the penetration plates 12*a* and 12*b*. In the same manner, the needles 74 are inserted from the one surface into the loop stitches K on the other surface of the penetration plates. Referring again to FIG. 14, if it is determined at the step S13 that the needles 74 are inserted into all the loop stitches K on both the surfaces, linking is carried out by means of the sewing machine 100, by using the needles 74 of the point needle 68 and the guide grooves of the hooks 19*a* and 19*b*. Location information of the loop stitch regions is suitably stored in the image processor 26, or a memory device, not shown, externally provided. Alternatively, the information is input into the linking apparatus having a function of relatively changing the locations of the point needle and the tubular knitted fabric, for use in automatic insertion of the point needle into the loop stitches.

In the present embodiment, the description has been made of a case where stitches other than the loop stitches are not extracted by the loop stitch region extracting section 36. However, stitches other than the loop stitches can be extracted if the area of the labeled region of the stitch exceeds the area threshold value. To eliminate such an inconvenience, it is possible to set a loop stitch expected location beforehand, based on loop stitch location information obtained when the unfinished hosiery W is arranged on the penetration plates 12*a* and 12*b*, and the labeled regions of stitches arranged nearest to the expected location are extracted as the loop stitch regions, by referring to the expected location. Further, if no region of the loop stitches X is extracted in the vicinity of the expected location, the area threshold value obtained before is lowered, and then the above described processing may be repeatedly executed until the loop stitch regions are extracted in the vicinity of the expected location.

When the point needle 68 is thrust to the loop stitches K, it is not necessary to move both the point needle 68 and the fabric. For instance, only the point needle 68 may be vertically and laterally moved in one plane or on a two-dimensional basis to be guided to the locations of the loop stitches, while the fabric being fixed. Alternatively, only the fabric may be vertically and laterally moved in one plane or on the two-dimensional basis, by arranging rollers at upper and lower, and right and left locations of the fabric, while the point needle being fixed, whereby the point needle 68 is guided to the locations of the loop stitches K.

According to the above described tubular knitted fabric-linking apparatus 1 of the present embodiment, the needles 74 of the point needle 68 are only opposed to the one surface of the penetration plates, and the needles 74 are inserted into the loop stitches K arranged on the one surface of the penetration plates, followed by insertion thereof into the loop stitches K on the other surface of the plates, but this is not limitative. Alternatively, point needles may be provided such that the needles 74 are opposed to both the one surface and the other surface of the penetration plates. In this alternative case, the needles opposed to the one surface may be inserted into the loop stitches arranged on the one surface, and the needles opposed to the other surface may be inserted into the loop stitches arranged on the other surface, respectively, followed by abutting the needles on both the surfaces, whereby the needles on one of the surfaces are inserted into the loop stitches on the other surface of the plates to transfer the same. On this occasion, upon insertion of the needles on the one surface into the loop stitches on both the surfaces, to prevent the loop stitches from slipping out of the same, it is preferable to press each of tip portions of the needles by a slipout preventing element.

According to the tubular knitted fabric-linking apparatus 1 of the above embodiment, a plurality of the needles 74 are inserted into the loop stitches K in order from the and portion thereof. Alternatively, according to the present invention, the needles 74 may be inserted into a suitable number of the loop stitches K spaced at suitable regular intervals out of a plurality of the loop stitches K, and the remaining needles 74 may be guided to the remaining loop stitches K, whereby the needles 74 may be almost simultaneously inserted into the relevant loop stitches K.

Further, according to the tubular knitted fabric-linking apparatus 1 of the above embodiment, if the locations of the needles 74 correspond, respectively, to the locations of the plurality of the loop stitches K, the needles 74 may be almost simultaneously inserted into the loop stitches K.

Although the invention has been described in detail with reference to the drawings, it is apparent that the drawings illustrate only a diagrammatic form and an embodiment but do not define features of the invention. The true spirit and scope of the present invention can be embodied only by appended claims.

What is claimed is:

1. A process for detecting loop stitches of a tubular knitted fabric, comprising the steps of:

extending said tubular knitted fabric by penetrating a penetration element through an interior of said tubular knitted fabric having said loop stitches formed therein;

picking up a multi-gradation image including an image of loop stitches of said tubular knitted fabric extended by said penetration element; and detecting locations of said loop stitches by processing said multi-gradation image.

2. A process as claimed in claim 1, including the step of extending said tubular knitted fabric in a penetration direction of said penetration element.

3. A process as claimed in claim 1 or 2, wherein said step of picking up a multi-gradation image is carried out in one plane.

4. A process as claimed in claim 1 or 2, wherein said step of picking up multi-gradation image is carried out by using light transmitted from said interior of said tubular knitted fabric to an exterior of the same.

5. A process as claimed in claim 1 or 2, wherein said penetration element is composed of an element having a slit therein, and wherein said step of picking up a multi-gradation image includes the steps of irradiating said slit, and using light transmitted from one side of an exterior of said tubular knitted fabric to the other side of the same through said slit.

6. A process as claimed in claim 1 or 5, wherein said step of detecting said locations of said loop stitches comprises the steps of:

converting said multi-gradation image into a binary image;

converting said binary image into a labeled image composed of labeled regions;

counting the number of picture elements of each of said labeled regions in said labeled image, and then extracting only labeled regions each having a larger number of picture elements than a predetermined value, said predetermined value being set to a value larger than a reference value corresponding to a minimum value of the number of picture elements forming a labeled region of each of said loop stitches in said labeled image, to thereby generate an extracted labeled image; and determining a location of each of said loop stitches by calculating a location of said labeled region of each of said loop stitches in said extracted labeled image.

7. A process as claimed in claim 6, wherein said step of converting said multi-gradation image into said binary image includes the step of dividing said multi-gradation image into a plurality of small regions, and determining a binarization threshold value for each of said small regions, based on image features of each of said small regions.

8. An apparatus for detecting loop stitches of a tubular knitted fabric, comprising;

a penetration element for extending said tubular knitted fabric by penetrating the same through an interior of said tubular knitted fabric having said loop stitches formed therein;

image pickup means for picking up a multi-gradation image including a image of loop stitches of said tubular knitted fabric extended by said penetration element; and loop stitch detecting means for detecting locations of said loop stitches by processing said multi-gradation image.

9. An apparatus as claimed in claim 8, including upper retaining means for retaining said tubular knitted fabric at a location higher than said loop stitches, to thereby move said tubular knitted fabric in a penetration direction of said penetration element, and lower retaining means for retaining said tubular knitted fabric at a location lower than said loop stitches, to thereby move said tubular knitted fabric in said penetration direction of said penetration element.

10. An apparatus as claimed in claim 8 or 9, wherein said penetration element has surfaces on which said loop stitches are arranged, at least said surfaces of said penetration element being made flat, and wherein said image pickup means are disposed such that image pickup directions thereof are set at right angles with respect to a lateral direction of said flat surfaces of said penetration element.

11. An apparatus as claimed in claim 8 or 9, wherein said penetration element includes light emitting means.

12. An apparatus as claimed in claim 8 or 9, wherein said penetration element has a slit formed therein, and irradiating means for irradiating said slit.

13. An apparatus as claimed in claim 8 or 9, wherein said loop stitch detecting means comprise:

means for converting said multi-gradation image into a binary image;

means for converting said binary image into a labeled image composed of labeled regions;

region extracting means for counting the number of picture elements of each of said labeled regions in said labeled image, and then extracting only labeled regions each having a larger number of picture elements than a predetermined value, said predetermined value being set to a value larger than a reference value corresponding to a minimum value of the number of picture elements forming a labeled region of each of said loop stitches in said labeled image, to thereby generate an extracted labeled image; and means for determining a location of each of said loop stitches by calculating a location of each of said labeled regions of said loop stitches in said extracted labeled image.

14. An apparatus as claimed in claim 13, wherein said means for converting said multi-gradation image into said binary image include means for dividing said multi-gradation image into a plurality of small regions, and determining a binarization threshold value for each of said small regions, based on image features of each of said small regions.

15. An apparatus for linking a tubular knitted fabric having loop stitches formed therein, comprising:

a penetration element for extending said tubular knitted fabric by penetrating the same through an interior of said tubular knitted fabric having said loop stitches formed therein;

image pickup means for picking up a multi-gradation image including an image of loop stitches of said tubular knitted fabric extended by said penetration element;

loop stitch detecting means for detecting locations of said loop stitches by processing said multi-gradation image;

a point needle for being inserted into said loop stitches;

means for guiding said point needle to said locations of said loop stitches detected by said loop stitch detecting means;

means for inserting said point needle to each of said loop stitches; and a sewing machine mechanism for linking said loop stitches into which said pointing needle is inserted.

16. An apparatus as claimed in claim 15, including upper retaining means for retaining said tubular knitted fabric at a location higher than said loop stitches, to thereby move said tubular knitted fabric in a penetration direction of said penetration element, and lower retaining means for retaining said tubular knitted fabric at a location lower than said loop stitches, to thereby move said tubular knitted fabric in said penetration direction of said penetration element.

17. An apparatus as claimed in claim 15 or 16, wherein said penetration element has surfaces on which said loop stitches are arranged, at least said surfaces of said penetration element being made flat, and wherein said image pickup means are disposed such that image pickup directions thereof are set at right angles with respect to said flat surfaces of said penetration element.

18. An apparatus as claimed in claim 15 or 16, wherein said penetration element includes light emitting means.

19. An apparatus as claimed in claim 15 or 16, wherein said penetration element has a slit formed therein, and irradiating means for irradiatiag said slit.

20. An apparatus as claimed in claim 15 or 16, wherein said loop stitch detecting means comprises:

means for converting said multi-gradation image into a binary image;

means for converting said binary image into a labeled image composed of labeled regions;

region extracting means for counting the number of picture elements of each of said labeled regions present in said labeled image, and then extracting only labeled regions each having a larger number of picture elements than a predetermined value, said predetermined value being set to a value larger than a reference value corresponding to a minimum value of the number of picture elements forming a labeled region of each of said loop stitches in said labeled image, to thereby generate an extracted labeled image; and means for determining a location of each of said loop stitches by calculating a location of each of said labeled region of said loop stitches in said extracted labeled image.

21. An apparatus as claimed in claim 20, wherein said means for converting said multi-gradation image into aid binary image include means for dividing said multi-gradation image into a plurality of small regions, and determining a binarization threshold value for each of said small regions, based on image features of each of said small regions.

22. An apparatus as claimed in claim 15 or 16, wherein said means for guiding said point needle to said locations of said loop stitches include means for moving said locations of said loop stitches in one direction, and means for moving said point needle in one direction orthogonal to said direction of said loop stitches.

23. An apparatus as claimed in claim 15 or 16, wherein said means for guiding said point needle to said locations of said loop stitches include mans for moving said point needle on a two-dimensional basis.

24. An apparatus as claimed in claim 15 or 16, wherein said means for guiding said point needle to said locations of said loop stitches include means for moving said locations of said loop stitches on a two-dimensional basis.

* * * * *